US007448967B1

(12) United States Patent
Panneri et al.

(10) Patent No.: US 7,448,967 B1
(45) Date of Patent: Nov. 11, 2008

(54) SELF-RIGHTING GOLF BALL TEE

(75) Inventors: Alfred J. Panneri, Cheektowaga, NY (US); Ralph G. Stuart, Hamburg, NY (US)

(73) Assignee: Panneri Machining Inc., Cheektowaga, NY (US)

( * ) Notice: Subject to any disclaimer, the term of this patent is extended or adjusted under 35 U.S.C. 154(b) by 0 days.

(21) Appl. No.: 11/852,284

(22) Filed: Sep. 8, 2007

(51) Int. Cl.
*A63B 57/00* (2006.01)

(52) U.S. Cl. ..... 473/387; 473/390

(58) Field of Classification Search ..... 473/387–403; D21/717, 386; 273/447, 288, 290, 291
See application file for complete search history.

(56) References Cited

U.S. PATENT DOCUMENTS

| | | | | | |
|---|---|---|---|---|---|
| 646,073 | A | * | 3/1900 | Hempel | 473/390 |
| 1,551,636 | A | * | 9/1925 | Bloom | 473/388 |
| D70,800 | S | * | 8/1926 | McDonald | D21/386 |
| 1,658,226 | A | * | 2/1928 | Clausing | 473/390 |
| 1,671,630 | A | * | 5/1928 | Duganne | 473/395 |
| 2,074,519 | A | | 3/1937 | Shephard | |
| 2,153,260 | A | * | 4/1939 | Mayl | 473/389 |
| 2,167,074 | A | * | 7/1939 | Hilker | 273/146 |
| D126,841 | S | | 4/1941 | Singer | |
| 2,555,222 | A | | 5/1951 | Coleman et al. | |
| D177,323 | S | * | 4/1956 | Guest | D21/386 |
| 3,141,671 | A | | 7/1964 | Eyer | |
| 3,239,264 | A | | 3/1966 | Dupont | |
| 4,313,604 | A | | 2/1982 | Baxter | |
| 5,310,189 | A | | 5/1994 | Soto | |
| 5,460,366 | A | | 10/1995 | Pugh | |
| 5,839,972 | A | | 11/1998 | Swanson | |
| 5,857,927 | A | | 1/1999 | Driscoll et al. | |
| 5,899,511 | A | | 5/1999 | Dinatale | |
| 6,139,449 | A | * | 10/2000 | Cardarelli | 473/387 |
| 6,159,108 | A | | 12/2000 | de la Pena | |
| 6,817,955 | B2 | | 11/2004 | O'Donnell et al. | |
| 2008/0064517 | A1 | * | 3/2008 | Stuart | 473/132 |

FOREIGN PATENT DOCUMENTS

| | | |
|---|---|---|
| JP | 2005137621 | 6/2005 |

* cited by examiner

*Primary Examiner*—Steven Wong
(74) *Attorney, Agent, or Firm*—Walter W. Duft

(57) ABSTRACT

A self-righting golf ball tee. The tee may comprise plural golf ball supporting pedestals, for example, four pedestals that are evenly spaced from each other. The pedestals may extend from a central hub, such as at an angle of approximately 109.5 degrees between each pedestal. The pedestals may be constructed as ribbed structures and the central hub may define openings that facilitate tee retrieval. During use, a golfer tosses the tee onto the ground. The tee will orient itself with three of the pedestals contacting the ground and the remaining pedestal protruding vertically upwardly to receive a golf ball. Following a golf shot, a tee retrieval tool may be used to engage one of the openings in the central hub.

10 Claims, 8 Drawing Sheets

SELF-RIGHTING GOLF BALL TEE

CROSS-REFERENCE TO RELATED APPLICATIONS

This application is related to U.S. application Ser. No. 11/531,416, filed on Sep. 13, 2006 and entitled "Self-Righting Golf Ball Tee."

BACKGROUND OF THE INVENTION

1. Field of the Invention

The present invention relates to the field of golfing, and more particularly to golf ball tees.

2. Description of Prior Art

Golf ball tees are conventionally designed as elongated pegs having a pointed end that is inserted in the ground and an upper end formed as a cup-shaped pedestal that holds a golf ball during driving. In order to tee a golf ball, a golfer must bend over and manipulate the pointed end into the ground, being careful to ensure that the tee is substantially upright so that the ball does not roll off the pedestal prior to the drive being made. Following the drive, the tee must be picked up manually by the golfer. For some golfers, their physical condition makes it difficult to bend the back or knees in order to position the tee for a drive, and thereafter retrieve the tee for subsequent drives. Accordingly, it is to improvements in such devices that the present invention is directed. What is particularly needed is a golf ball tee that does not require the effort associated with using a conventional golf tee when driving a golf ball.

SUMMARY OF THE INVENTION

The foregoing problems are solved and an advance in the art is achieved by a self-righting golf ball tee. The tee may comprise plural golf ball supporting pedestals, for example, four pedestals that are evenly spaced from each other. The pedestals may extend from a central hub, such as at an angle of approximately 109.5 degrees between each pedestal. If desired, the pedestals may be constructed as ribbed structures and the central hub may define openings that facilitate tee retrieval. During use, a golfer tosses the tee onto the ground. The tee will orient itself with three of the pedestals contacting the ground and the remaining pedestal protruding vertically upwardly to receive a golf ball. If necessary, the tee may be tamped or otherwise adjusted by a golfer to ensure that the upright pedestal is correctly positioned, and a golf ball may be placed thereon, as by using a golf ball teeing device. Following a golf shot, a tee retrieval tool may be used to engage one of the openings in the central hub.

BRIEF DESCRIPTION OF THE DRAWINGS

The foregoing and other features and advantages of the invention will be apparent from the following more particular description of exemplary embodiments of the invention, as illustrated in the accompanying Drawings in which.

DETAILED DESCRIPTION OF EXEMPLARY EMBODIMENTS

Figure 1A:
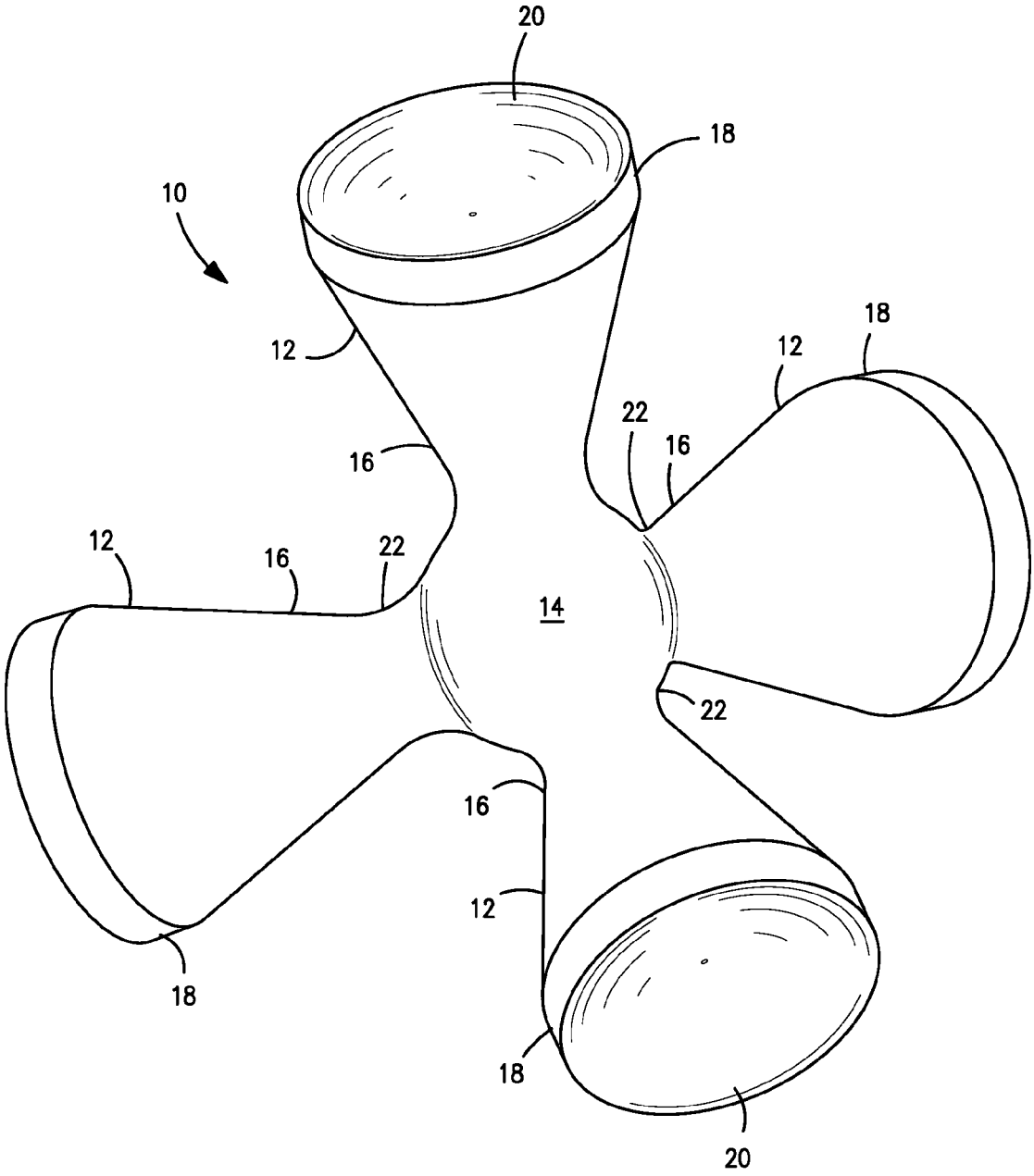
FIG. 1A is a perspective view showing a self-righting golf tee.
Figure 2C:
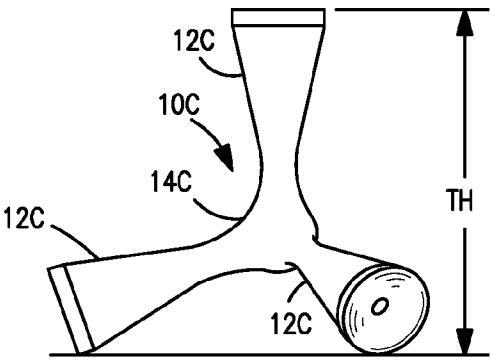
FIG. 2C is a side elevational view showing the self-righting golf tee of FIG. 1C.
Figure 2B:
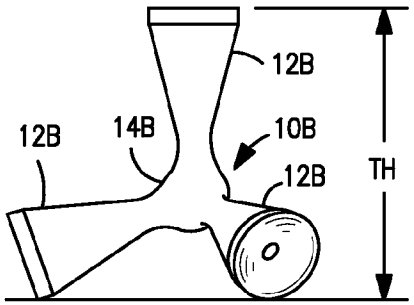
FIG. 2B is a side elevational view showing the self-righting golf tee of FIG. 1B.
Figure 2A:
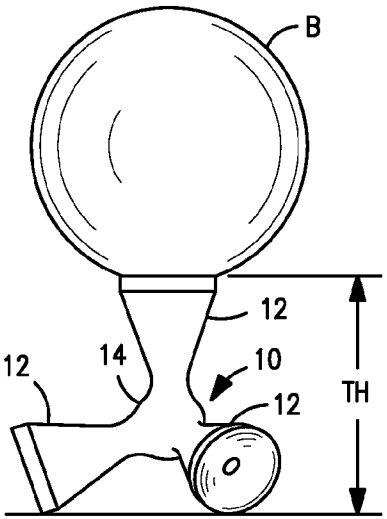
FIG. 2A is a side elevational view showing the self-righting golf tee of FIG. 1A supporting a golf ball.

Turning now to the drawings wherein like reference numerals indicate like elements in all of the several views, FIGS. 1A and 2A, an exemplary golf ball tee 10 is shown. The tee 10 may include plural golf ball supporting pedestals 12, for example, four pedestals that are equally angularly spaced from each other. The pedestals 12 may extend from a central hub 14 that is generally spherical in shape, but which could alternatively have any other desired shape. The pedestals 12 may be generally frustoconical in shape, with the narrow end 16 of the frustocone being affixed to the hub 14 and the wide end 18 of the frustocone defining a cup 20 that supports a golf ball "B" (see FIG. 2A) during a golf shot. Optional fillets 22 may be formed between the frustocone narrow ends 16 and the hub 14 in order to provide a smooth rounded transition between the hub and the pedestals 12.

The respective longitudinal axes of the pedestals 12 may be angularly separated from each other by an angle of approximately 109.5 degrees. With this geometry (and because the pedestals are of equal length), one of the pedestals 12 will always be perpendicular to the plane of contact between the three remaining pedestals and a support surface on which the other three pedestals are in contact. As a result, when any three of the pedestals 12 are in contact with level ground, the remaining pedestal will point vertically upwardly. Moreover, the hub 14 will be located at the center of gravity of the tee 10. This means that each pedestal 12 should have a statistically equal chance of being the vertical pedestal when the tee is tossed on the ground.

The tee 10 can be constructed using any suitable manufacturing technique, including injection molding, machining, etc. The tee 10 may be formed as an integral whole or it could be assembled from discrete components. For example, the central hub 14 could be formed as one component and the pedestals 12 could be separately mounted thereto as additional components. To facilitate such mounting, the central hub 14 could be formed with bores and the pedestals 12 could be formed with posts that seat in the bores. An adhesive could be used to secure the posts in the bores. Alternatively, the bores and posts could be threaded to provide a threaded connection. If desired, central hub 14 may optionally comprise a magnetically attractive material so that the tee 10 can be retrieved by a magnetized tee retriever. The magnetically attractive material may comprise a metal object (e.g., a steel ball) disposed within the hub 14, or if desired, by making the entire hub out of metal. The remainder of the tee may be constructed from wood, a polymer plastic, or other suitable material.

Figure 1B:
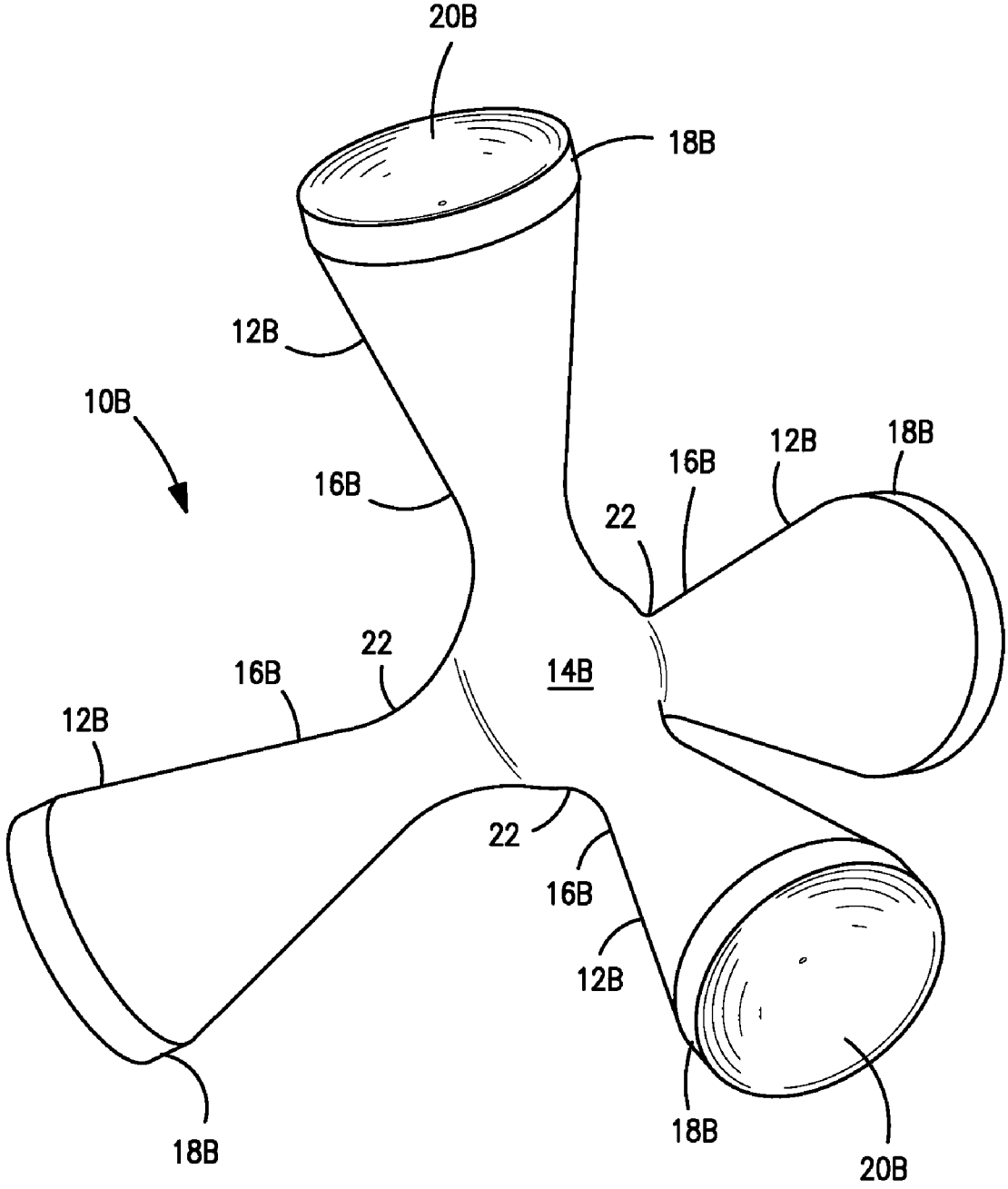
FIG. 1B is a perspective view showing the self-righting golf tee of FIG. 1A in a larger size.
Figure 1C:
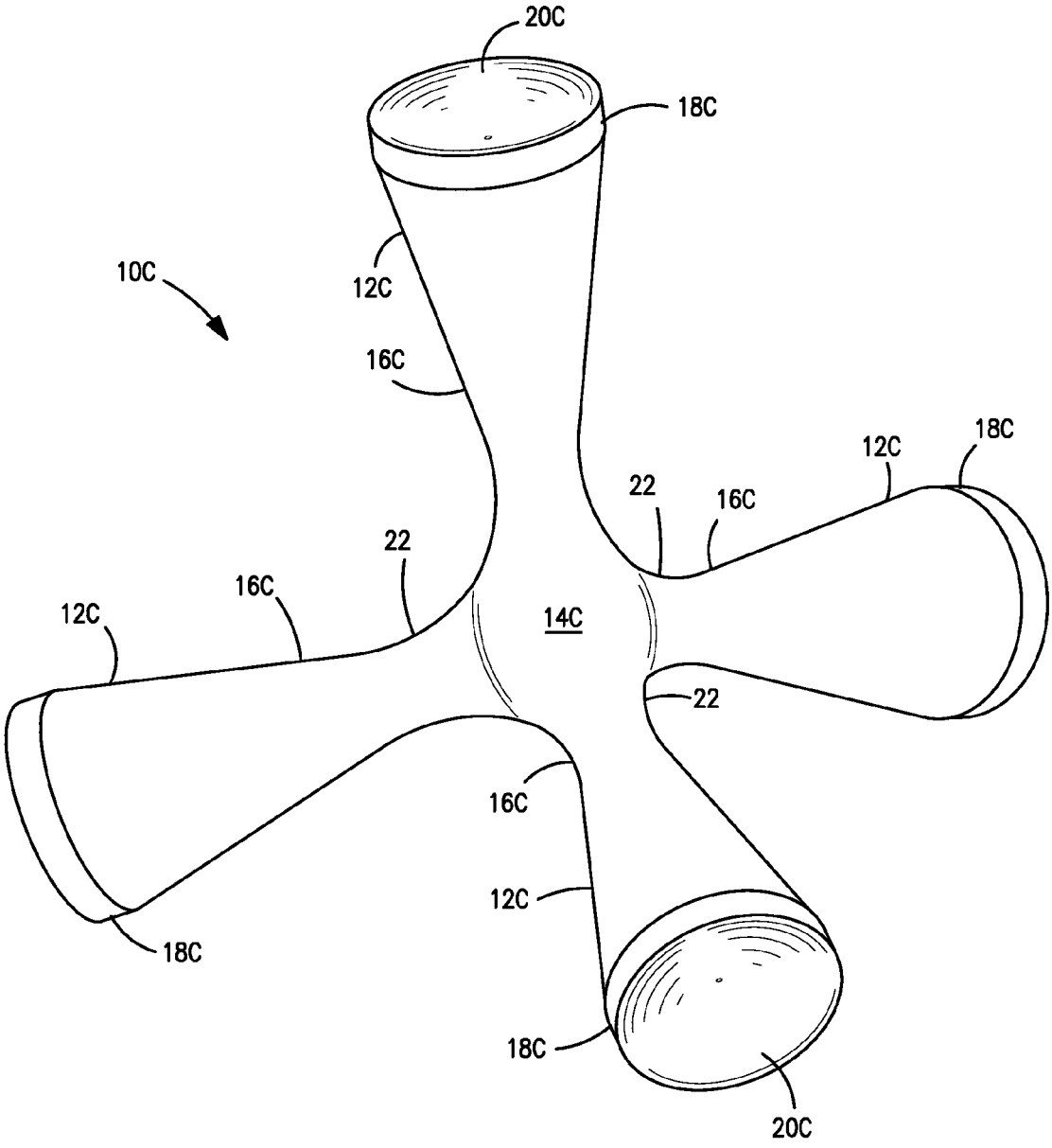
FIG. 1C is a perspective view showing the self-righting golf tee of FIG. 14A in a still larger size.

The tee 10 may be manufactured in different sizes to provide a range of tee heights. FIGS. 1A and 2A show a nominal size version of the tee 10. FIGS. 1B and 2B show a tee 10A that is larger in size than the nominal tee 10. FIGS. 1C and 2C show a tee 1C that is larger in size than the tee 1B. FIGS. 2A, 2B and 2C illustrate the difference in tee height "TH" between the tees 10, 10B and 10C, where "TH" is the distance from the ground to the top of the vertically-extending pedestal 12, 12B or 12C. By way of example only, the height "TH" in FIG. 2A could be 1.5 inches, the height "TH" in FIG. 2B could be 1.75 inches, and the height "TH" in FIG. 2C could be 2.0 inches. Other sizes could also be provided. Apart from their size, the tees 10B and 10C are identical in all respects to the tee 10, as shown by the use of corresponding reference numbers. As such, the above description of the tee 10 applies equally to the tees 10B and 10C, and need not be repeated relative to FIGS. 1B/2B and 1C/2C.

Figure 3:
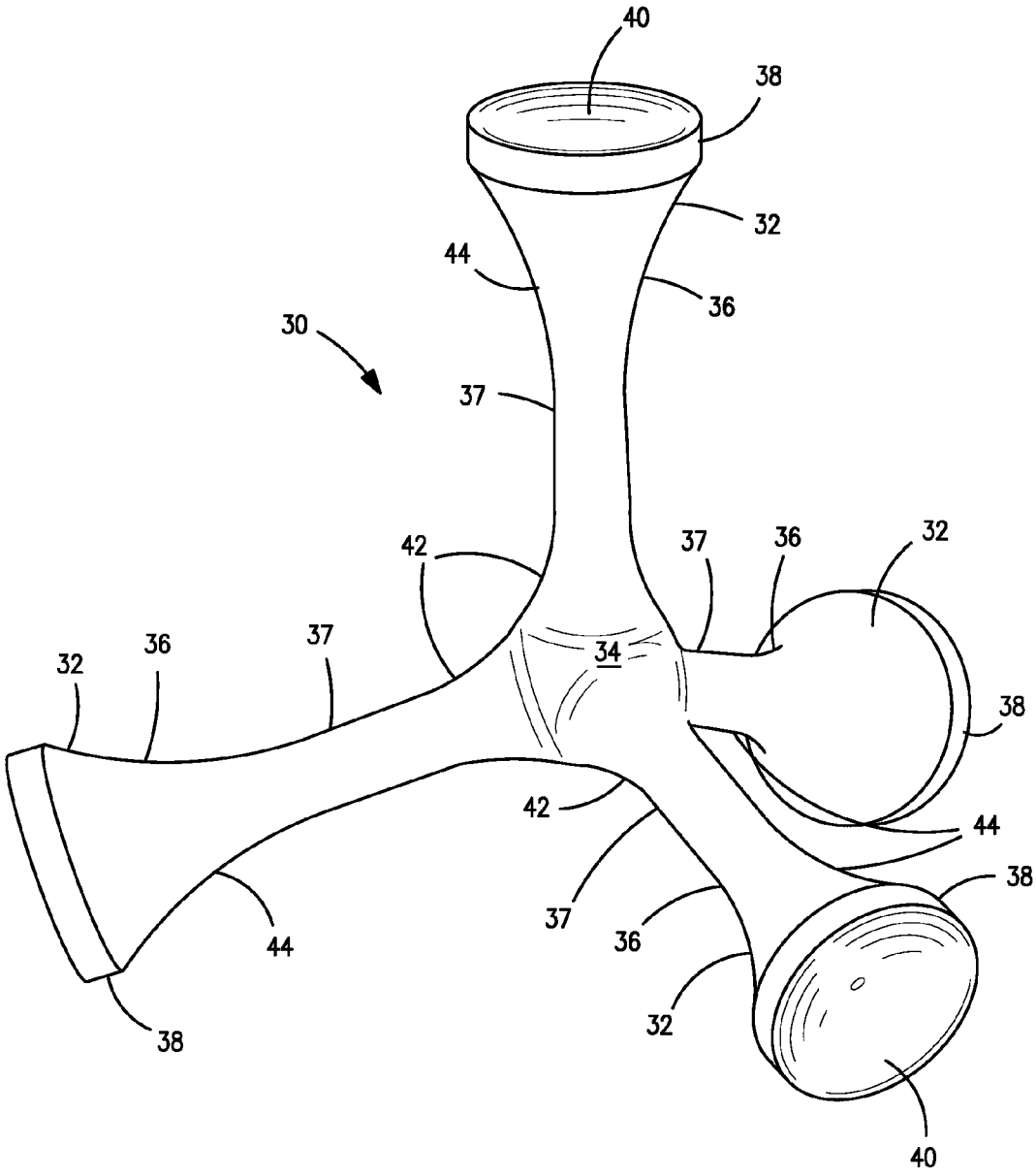
FIG. 3 is a perspective view showing a modified self-righting golf tee.

Turning now to FIG. 3, a modified self-righting golf ball tee 30 is shown. The tee 30 is similar to the tees 10, 10B and 10C described above, except that the narrow end 36 of the pedestal frustocone is connected to the hub 34 via a slender cylindrical stem 37. This reduces the weight of the tee 30 and gives a less bulky appearance than the tees 10, 10B and 10C. To further reduce the bulk and weight of the tee 30, the size of the hub 34 may be reduced as desired. In some cases, the hub 34 could be reduced in size to the diameter of the stems 37, such that the stems (or the pedestals) appear to be centrally joined together without a distinct hub. If the hub 34 is larger than the stem diameter, a fillet 42 may be formed between the hub and the stems 37 in order to provide a smooth rounded transition between the hub and the stems. A fillet 44 may also be formed between the stems 37 and the frustocone narrow ends 36 of the pedestals 32 in order to provide a smooth rounded transition between the stems and the pedestals. As in the case of the tees 10, 10B and 10C, the tee 30 may be fabricated in different sizes to provide different teeing heights.

Figure 4A:
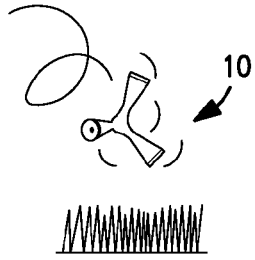
FIG. 4A is a perspective view showing a first stage of deployment of the self-righting golf tee of FIG. 1A.
Figure 4B:
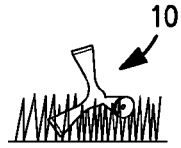
FIG. 4B is a perspective view showing a second stage of deployment of the self-righting golf tee of FIG. 1A.
Figure 4C:
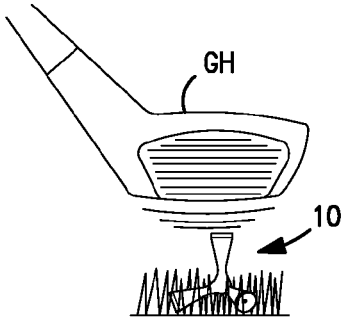
FIG. 4C is a perspective view showing a third stage of deployment of the self-righting golf tee of FIG. 1A.
Figure 4D:
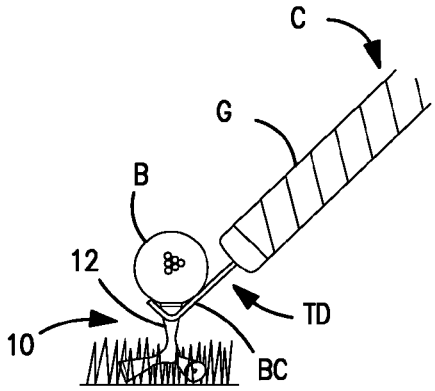
FIG. 4D is a perspective view showing placement of a golf ball on the golf tee of FIG. 1A using a golf ball teeing device.

Turning now to FIGS. 4A-E, an exemplary method of using the tee 10 is illustrated. FIG. 4A shows a first stage of deployment of the tee 10 in which the tee has been tossed or dropped toward the ground by a golfer. FIG. 4B shows a second stage of deployment of the tee 10 wherein the tee has landed on the ground. Due to the turf growing on the ground, the upright pedestal 12 of the tee 10 may be tilted from vertical. To remedy this situation, the tee 10 can be leveled by the golfer using his/her foot or by tamping the tee with a golf club. FIG. 4C illustrates a third stage of deployment of the tee 10 wherein the tee 10 is tamped using the bottom of the golf club head "GH." FIG. 4D shows the placement of a golf ball "B" onto the tee 10. Although the golfer could bend over and manually place the golf ball "B" on the tee 10, this manual placement can be avoided by using a golf ball teeing device. Any conventional teeing device may be used for this purpose. Alternatively, a teeing device "TD" as disclosed in copending application Ser. No. 11/531,378, entitled "Golf Ball Teeing Device," (the entire contents of which are hereby incorporated herein by this reference) may be used. The teeing device "TD" is adapted to be mounted to the grip end "G" of a golf club "C." Prior to ball placement, the golfer will have positioned the teeing device "TD" in an operational position by extending a two-member ball carrier "BC" thereof, inverted the golf club "C" so that the ball carrier is facing downwardly, and placed the golf ball "B" in the cup defined by the 90 degree bend near the free ends of the ball carrier members. Using the teeing device "TD," the golfer gently places the golf ball "B" on the upright pedestal 12 of the golf tee 10, then disengages the ball carrier "BC" by maneuvering it downwardly and way from the ball. The teeing device "TD" may then be returned to a stowage position and the golf club "C" may be used in conventional fashion to drive the golf ball "B" off the tee 10.

Figure 4E:
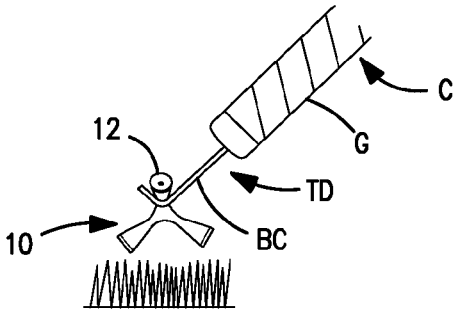
FIG. 4E is a perspective view showing retrieval of the golf tee of FIG. 1A using the golf ball teeing device of FIG. 4D following a golf shot.
Figure 5:
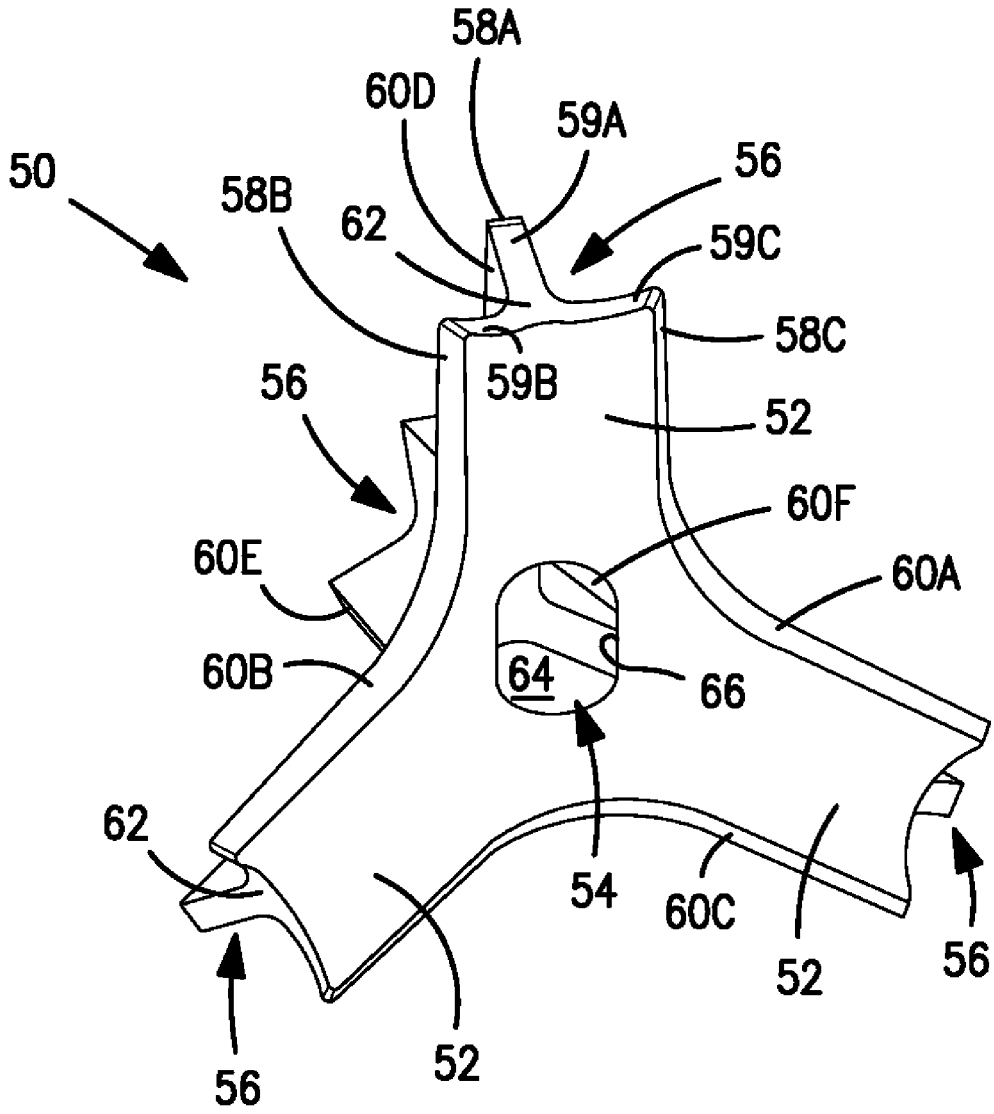
FIG. 5 is a perspective view showing a further modified self-righting golf tee.
Figure 6:
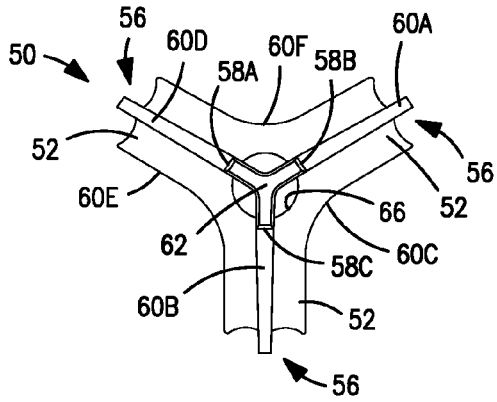
FIG. 6 is top view of the self-righting golf tee of FIG. 5.
Figure 7:
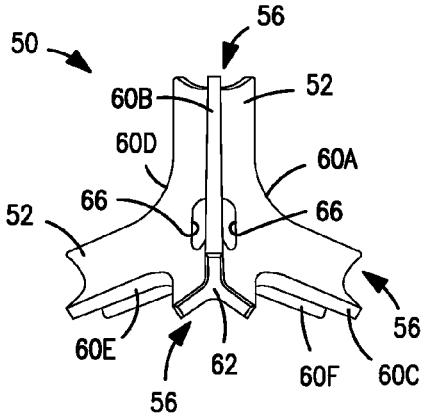
FIG. 7 is a further perspective view of the self-righting golf tee of FIG. 5.
Figure 8:
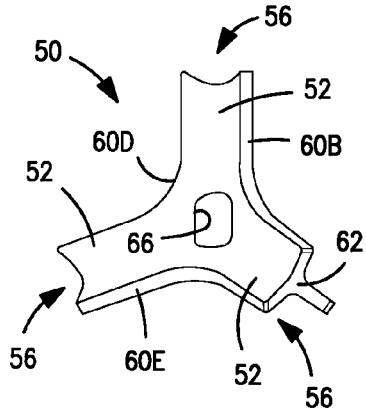
FIG. 8 is side view of the self-righting golf tee of FIG. 5.
Figure 9:
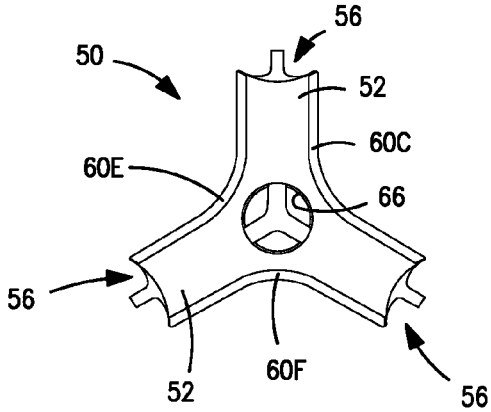
FIG. 9 is bottom view of the self-righting golf tee of FIG. 5.

The tee 10 may be retrieved by the golfer following the shot. This can be done manually if the golfer wishes to bend over and pick up the tee 10. Alternatively, as shown in FIG. 4E, a teeing device "TD" may be used to retrieve the tee 10. For this operation, the golfer simply needs to place the teeing device "TD" in its extended position, invert the golf club "C" and pick up the tee 10 by using the ball carrier "BC" to hook one or more of the pedestals 12. This can be facilitated by turning the golf club "C" so that the free ends of the ball carrier members are oriented generally horizontally, and then maneuvering the ball carrier members into engagement with the tee 10, rotating the golf club "C" so that the free ends of the ball carrier members are angled upwardly to cradle the tee, and lifting the club. Tee retrieval may also be accomplished by pointing the ball carrier "BC" downwardly while in its operational position over the tee 10, so that the ball carrier members straddle the upright pedestal 12. The teeing device "TD" may then be pushed downwardly such that the ball carrier members engage the tee 10 and the ball carrier "BC" retracts to its stowage position. In doing so, the free ends of the ball carrier members will act as a pair of tweezers to pinch the upright pedestal 12 and thereby capture the tee 10.

Turning now to FIGS. 5-9, a further modified self-righting golf ball tee 50 is shown. The tee 50 includes plural golf ball supporting pedestals 52 extending outwardly from a central hub 54. Although the number of pedestals 52 may vary, the tee 50 is shown as having four pedestal that are equally angularly spaced from each other and of substantially equal length. For the reasons discussed above in connection with the tees 10, 10B, 10C and 30, the angle between adjacent pedestals 52 may be approximately 109.5 degrees. The free end of each pedestal 52 is concave in shape order to form a cup 56 that receives and supports a golf ball during a golf shot.

The tee 50 is similar to the tees 10, 10B, 10C and 30 described above, except that the hub 54 is hollow in order facilitate tee retrieval using the teeing device "TD" of FIGS. 4A-4E, or other tool. In addition, the pedestals 52 are formed as ribbed structures. In particular, each pedestal 52 has a triangular cross-sectional configuration comprising three ribs 58A, 58B and 58C. The ends of the ribs 58A-58C at the free end of each pedestal 52 are tapered in order to form three prongs 59A, 59B and 59C (see FIG. 5) that define the cup 56. As can be best seen in FIG. 6, the ribs 58A-58C of each pedestal may be angularly separated from each other by an angle of approximately 120 degrees. In a four pedestal configuration wherein each pedestal is separated by an angle of approximately 109.5 degrees, the 120 degree angle of the ribs 58A-58C happens to be the apparent projection angle formed between any three of the pedestals when the tee 50 is viewed along the axis of the remaining pedestal. This is the view shown in FIG. 6. It will be seen that the ribs 58A-58C of the pedestal 52 that faces the reader are in perfect alignment with corresponding ribs of the remaining three pedestals. Moreover, the ribs 58A-58C of adjacent pedestals 52 extend from the free ends the pedestals to the area of the hub 54 where the ribs are interconnected. This interconnection of ribs on adjacent pedestals results in the formation of six longitudinal ridges 60A, 60B, 60C, 60D, 60E and 60E that respectively extend continuously between each of the six pairs of adjacent pedestals. The ridges 60A-60E add stiffness and strength to the tee 50 and allow it to be formed from a flexible resilient material, such as a thermoplastic elastomer (TPE), also known as thermoplastic rubber, that will resist fracture when impacted by a golf club during a drive. Whereas the pedestals 52 might be too flexible if constructed according to the design of the tees 10, 10B, 10C and 30 described above, the ridged construction of the tee 50 allows the pedestals to be sufficiently stiff and durable to perform their required functions. The ridged design also reduces the weight of the tee 50 and allows less material to be used.

It will be appreciated that other high-stiffness, low weight pedestal configurations may also be used. For example, instead of forming each pedestal with three ribs 58A-58C, additional (or fewer) ribs could be used. Moreover, whereas each pedestal 52 of the tee 50, when viewed in cross-section as per FIG. 6, has ribs extending outwardly from a central spine 62 that defines a pedestal longitudinal axis, it would be possible to use pedestal configurations that lack a central spine. For example, although not shown, the pedestals 52 could be formed with a continuous rib that defines a close-walled box structure having a hollow interior. Such box structures could be of any desired cross-sectional shape, including triangular, rectangular, hexagonal, circular, elliptical, etc., depending on the number of sides used. The latter pedestal configurations may be referred to as open-core ribbed structures, whereas pedestal configurations having a central spine, such as the spine 62 of the tee 50, may be referred to as closed-core ribbed structures.

The hub 54 includes a central cavity 64 (see FIG. 5) formed at the intersection of the six ridges 60A-60F. The cavity 64 is sized so as to cut away an interior portion of each ridge 60A-60F where the central spines 62 intersect. This defines four openings 66 that are interconnected by the cavity 64 to form a large perforation through the hub 54. Applicants have observed that this perforation helps reduce the distance that the tee 50 will "fly" in the event that it is struck by a golf club during a tee shot. The openings 66 are also adapted to receive one (or two) of the free ends of the ball carrier "BC" shown in FIGS. 4D and 4E (or other tee retrieval device). Because the openings 66 are all interconnected by the cavity 64, the ball carrier free ends can extend into the tee 50 (and preferably through it) in order to "hook" the tee so that it can be picked up without dropping. It will be seen in FIG. 9 that the opening 66 on the bottom of the tee 50 is generally circular while the remaining openings are generally oblong. This shape is due to a technique that may be used to form the cavity 64 when the tee 50 is made by injection molding. In particular, the cavity 64 may be formed by a cylindrical mold element having a blunt rounded tip. The circular cross section of the mold element defines the circular shape of the bottom opening 66. The sides and rounded tip of the mold element defines the oblong shape of the remaining openings 66. Although the tee 50 could possibly be retrieved without having the openings 66 fully interconnected by the cavity 64 (e.g., the openings could be shallow recesses), the cavity makes the tee easier to picked up by a tool such as the ball carrier "BC." The cavity 64 also reduces the weight of the tee 50 and the amount of material required.

Accordingly, a self-righting golf tee has been disclosed that allows a golfer to position a tee for a golf drive simply by tossing it on the ground. It should, of course, be understood that the description and the drawings herein are merely illustrative, and it will be apparent that various modifications, combinations and changes can be made in accordance with the invention. As such, the invention is not to be in any way limited except in accordance with the spirit of the appended claims and their equivalents.

What is claimed is:

1. A self-righting golf tee comprising four golf ball support pedestals formed as ribbed structures and equally angularly separated from each other by an angle of approximately 109.5 degrees, said ribbed structures each comprising three ribs that are equally angularly separated from each other by an angle of approximately 120 degrees to form a "Y" shape when viewed in cross-section, said ribs of each pedestal being in alignment with corresponding ribs on adjacent pedestals so as to define substantially linear ridges of substantially equal width extending continuously between each pair of adjacent pedestals.

2. A golf tee in accordance with claim 1 wherein said pedestals comprise close-core ribbed structures.

3. A golf tee in accordance with claim 1 wherein said pedestals comprise free ends that are concave in order to form golf ball-holding cups.

4. A golf tee in accordance with claim 1 wherein said ribs on said pedestals have free ends that are tapered to form prongs that define golf ball-holding cups.

5. A golf tee in accordance with claim 1 wherein said golf ball support pedestals extend from a central hub.

6. A golf tee in accordance with claim 5 wherein said hub comprises plural openings of sufficient size to receive a golf ball retrieving tool.

7. A golf tee in accordance with claim 6 wherein said hub comprises a cavity.

8. A golf tee in accordance with claim 7 wherein said plural openings are interconnected by said cavity.

9. A golf tee in accordance with claim 8 wherein plural openings comprises oblong openings and a generally circular opening.

10. A self-righting golf ball tee comprising four golf ball support pedestals formed as ribbed structures having golf-ball support prongs at the free ends thereof, said pedestals being equally angularly separated from each other by an angle of approximately 109.5 degrees, said ribbed structures each comprising three ribs that are equally angularly separated from each other by an angle of approximately 120 degrees to form a "Y" shape when viewed in cross-section said ribs of each pedestal being in alignment with corresponding ribs on adjacent pedestals so as to define substantially linear ridges of substantially equal width extending continuously between each pair of adjacent pedestals said tee further comprising a central hub defining a cavity that opens to three oblong openings and a single generally circular opening.

* * * * *